US005718219A

United States Patent [19]

Boudreault

[11] Patent Number: 5,718,219

[45] Date of Patent: Feb. 17, 1998

[54] KITCHEN EXHAUST HOOD ASSEMBLY

[76] Inventor: Jean-Pierre Boudreault, 3839 Rachel, Montréal, P.Q., Canada, H1X 1Y7

[21] Appl. No.: 780,958

[22] Filed: Jan. 10, 1997

[51] Int. Cl.[6] ..... F24C 15/20

[52] U.S. Cl. ..... 126/299 E; 126/299 R; 55/242; 55/436; 55/DIG. 36

[58] Field of Search ..... 126/299 R, 299 D, 126/299 E, 312, 21 R; 55/DIG. 36, 242, 436, 442–444

[56] References Cited

U.S. PATENT DOCUMENTS

| | | | |
|---|---|---|---|
| 2,813,477 | 11/1957 | Gaylord | 126/299 E |
| 3,324,629 | 6/1967 | Graswich et al. | 126/299 E |
| 3,463,233 | 8/1969 | Haessler | 126/299 E |
| 4,250,870 | 2/1981 | Kuechler | 126/299 D |
| 4,266,529 | 5/1981 | Gaylord | 126/299 D |
| 4,281,635 | 8/1981 | Gaylord | 126/299 D |
| 5,540,214 | 7/1996 | Boudreault | 126/299 R |

*Primary Examiner*—James C. Yeung
*Attorney, Agent, or Firm*—Swabey Ogilvy Renault

[57] ABSTRACT

The exhaust hood assembly has a vertically disposed greast extractor which leads into a suction ventilator adapted for expelling air and odor to the outside. The assembly has a first deflector at the entrance into the grease extractor to cause a first swirl of the air loaded with grease, impurities and odors, and a first release thereof into a bucket provided below the greast extractor. Inside the greast extractor there are two deflectors to cause swirls of the air load with grease and odor and release of grease and particles into the bucket. Finally, any grease and/or impurities not released in the grease extractor are centrifugally expelled by the suction ventilator and sent through a tube which also feeds into the bucket. This device is inexpensive to produce and is much more efficient than those currently in use.

8 Claims, 2 Drawing Sheets

KITCHEN EXHAUST HOOD ASSEMBLY

BACKGROUND OF INVENTION

1. Field of Invention

This invention relates to a kitchen exhaust hhod assembly. More specifically, the present invention is concerned with an exhaust hood of the type which is specifically designed for commercial cooking appliances, and for use in residential homes or small commercial installations, which makes it possible to provide an increased suction of grease and odor while evacuating only a small volume of air. More particularly, the invention concerns a kitchen hood assembly with ventilator which combines a ventilator, a hood and a grease extractor wherein drainage of the ventilator is carried out in the exhaust hood assembly.

2. Description of Prior Art

Every modern kitchen is normally provided with a ventilator hood which is mounted immediately above the cooking plates or stove and whose purpose is to remove grease and odor produced when cooking. The ventilator is also used occasionally for exchanging some of the air inside a residence, especially ambient air in the kitchen. Most of the devices used are built on the same principle. An air duct provided with a filter sucks and leads some air from its vicinity into a suction ventilator of the fan or drum type, which thereafter expels it to the outside via another air duct. The main disadvantage of this system is that it is noisy, requires a frequent cleaning of the filter, and is mostly unsatisfactory because it removes only a small portion of the grease and odor produced during cooking. Other disadvantages include grease build-up in the duct, poor smoke capture and the like.

There is therefore a need for a piece of equipment which overcomes the disadvantages of the ventilators presently in use, in that it would eliminate most of the grease and odor produced when cooking without evacuating too much air, and would create an air movement that prevents any smoke, grease, odor from escaping out of the canopy, is not noisy when operating, and does not cost too much.

It is therefore an object of the present invention to provide an exhaust hood assembly which is highly efficient and does not require the use of greasy filters.

It is another object of the present invention to provide a kitchen exhaust hood assembly which may even 10 be used in the home and which performs even better than the best commercial ventilators which are used in hotels and restaurants.

SUMMARY OF THE INVENTION

In accordance with the invention there is provided a kitchen exhaust hood assembly for removing grease and odor produced above a cooking surface when cooking, which comprises a suction ventilator, a hood, a grease extractor to collect grease and direct odor produced when cooking toward said suction ventilator, and an air discharge duct to expel air and odors to the exterior. The grease extractor is vertically disposed and is in communication with the suction ventilator. The air loaded with grease and odor naturally rises toward a rear portion of the hood. A first deflection means is provided at an entrance into the grease extractor to cause the air loaded with grease and odor produced above the cooking surface which has naturally risen upwardly therefrom towards the rear portion of the hood to curve downwardly in the direction of the entrance to penetrate therein. A second deflection means is provided inside the grease extractor and is arranged to cause the air loaded with grease and odor to swirl around the second deflection means. Means are provided enabling first excess grease material centrifugally expelled by the suction ventilator and retained thereon to be removed therefrom. The assembly finally comprises bucket means to receive the excess grease material released by the first and second deflection means and the first excess grease material expelled by the suction ventilator.

In accordance with a preferred embodiment, the kitchen exhaust hood assembly comprises a supply of fire extinguishing material, means for spraying the fire extinguishing material at least towards said cooking surface, a fire extinguishing material duct connecting the supply of fire extinguishing material to the spraying means and a fire detector operatively disposed to detect the presence of fire in the vicinity of the hood and suction ventilator, and to cause opening of a valve disposed along the fire extinguishing material duct to deliver the fire extinguishing material to the spraying means.

Preferably, the grease extractor is truncated with decreasing rectangular cross-section and includes a front wall, a rear wall, side walls and a top partition, an opening being formed in the rear wall in the upper portion thereof to lead into an entrance of the suction ventilator.

In accordance with another preferred embodiment the bucket means is shaped to define third deflection means allowing the air loaded with grease and odor to rise above the bucket means and thereafter to swirl around the bucket means downwardly towards an entrance into the grease extractor.

In accordance with yet another embodiment the grease extractor is vertically disposed in the front part of the assembly in order to accentuate the natural air movement coming from the cooking surface.

Preferably, the bottom portion of the hood has inwardly upwardly inclined rear and front portions and a central substantially horizontal portion to cause a first swirling of said air loaded with grease and odor around the third deflection means.

The kitchen exhaust hood assembly according to the invention may also comprise hooking means to mount the bucket means at a lower edge of the front wall of the first air duct, the bucket means having an inclined rear face defining the third deflection means.

In accordance with yet another embodiment, the exhaust hood assembly according to the invention may comprise a door provided in the front wall of the grease extractor to give access inside the grease extractor.

The exhaust hood assembly may also comprise an enclosure for the suction ventilator, and a tubing connected at the lower portion of the enclosure and terminated above the bucket means, the tubing being adapted to feed the expelled grease material into the bucket means.

Preferably, the second deflection means may comprise a first vertical plate mounted inside the grease extractor against the front wall of the grease extractor and at the bottom thereof and terminating short of the rear wall of the grease extractor, and a second vertical plate mounted inside the grease extractor against the rear wall thereof and terminating short of the front wall.

In accordance with yeat another preferred embodiment, the spraying means comprise a supply of fire extinguishing material and a duct therefor connected to the supply and extending through the grease extractor duct and over the cooking surface. Sprayers are mounted at the free end of the extinguishing material duct and along thereof to spray the cooking surface, the grease extractor and the suction ventilator.

BRIEF DESCRIPTION OF DRAWINGS

The invention is illustrated but is not limited by the embodiment which is represented by the annexed drawing, in which.

DESCRIPTION OF PREFERRED EMBODIMENT

Figure 1:
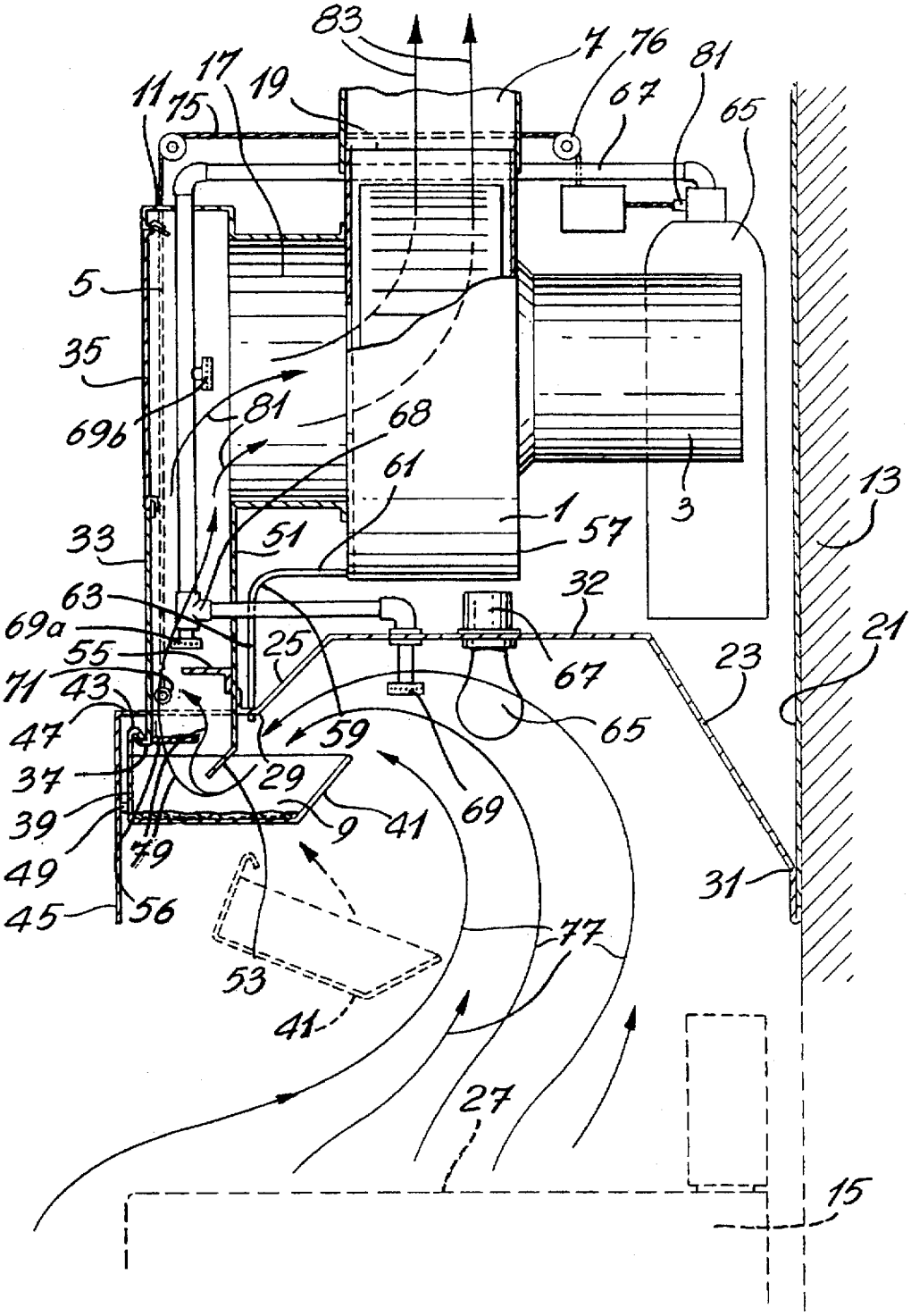
FIG. 1 is a schematic vertical cross-section view of a kitchen exhaust hood assembly according to the invention.
Figure 2:
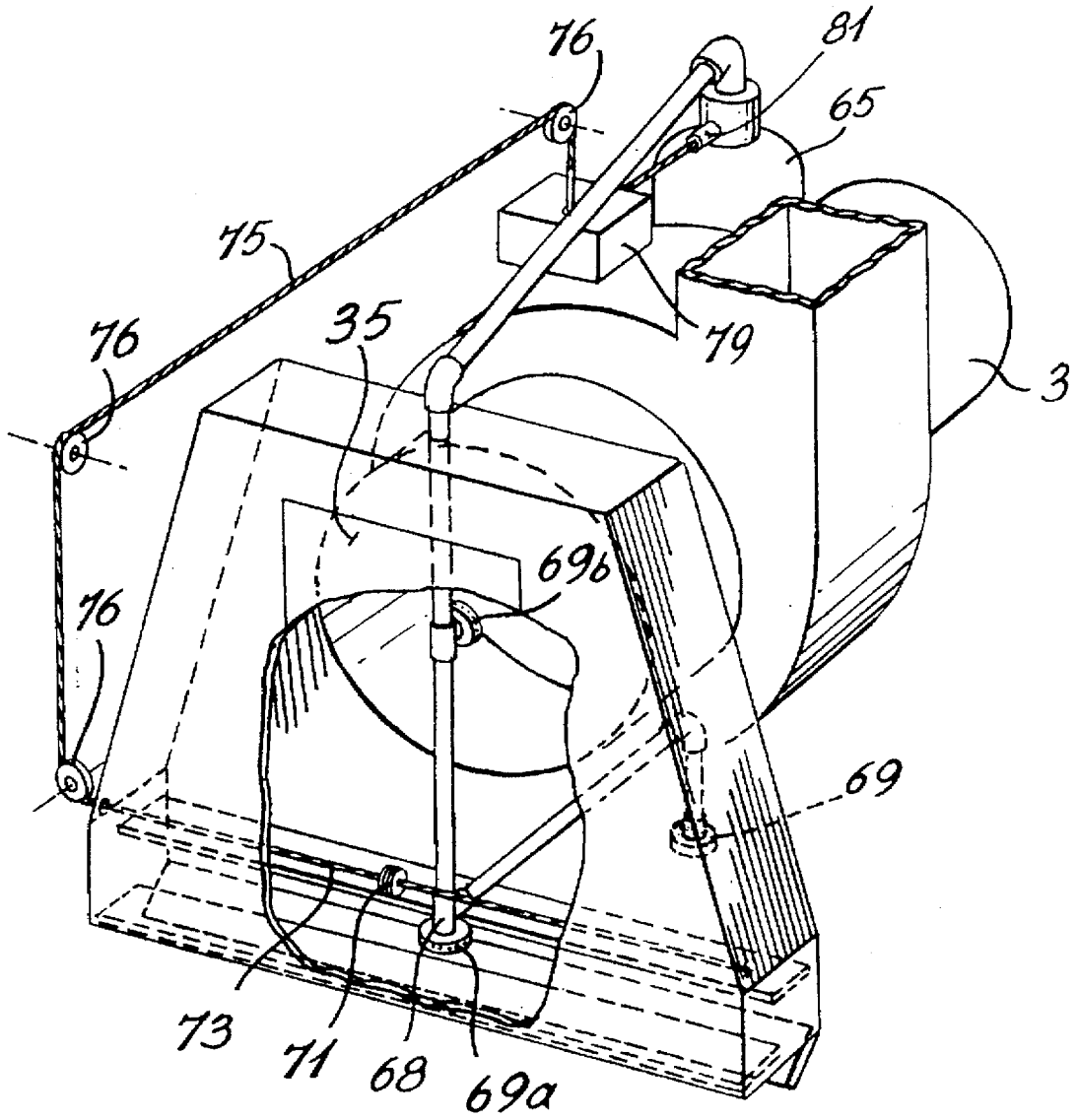
FIG. 2 is a perspective view of a grease extractor and fan included in the exhaust hood assembly according to the invention.

With reference to the drawing, it will be seen that the exhaust hood assembly which is illustrated includes a suction ventilator 1 operatively connected in known manner to a motor 3, a grease extractor 5, an air discharge duct 7 and a bucket 9, all contained in an exhaust hood assembly 11. In the embodiment which is illustrated, the exhaust hood assembly is constructed to be mounted against a wall 13 of a kitchen, although this is not absolutely essential, for any kind of mounting (such as an island) can be used, as will be appreciated by one skilled in the art. The exhaust hood assembly is disposed over a cooking surface, in the present case a kitchen stove 15 illustrated in dotted lines.

The suction ventilator and motor combination 1, 3 as well as the inlet 17 therein and outlet 19 therefrom are of course conventional, and as such do not form part of the inventive aspect of the assembly according to the invention.

Generally speaking, exhaust hood assemblyll is a box-like structure. More specifically, it has a rear wall 21 which, in the present case, is fixed against wall 13 in known manner (not shown). Neither the top wall nor the side walls are shown for purpose of simplification.

The bottom partition of exhaust hood assembly 11 is of special construction and includes a hood with rear portion 23 which is inwardly and upwardly inclined as shown. The hood also includes a front portion 25 which is also inwardly and upwardly inclined. It will be noted, however, that for design purposes mainly intended at more efficiently collecting grease- and odor-loaded air formed in the vicinity of the cooking surface 27, the lower edge 29 of front portion 25 is at a substantially higher level than the lower edge 31 of rear portion 23. Inclined rear and front portions 23 and 25 are joined together by means of a flat horizontal portion 32.

The front partition of exhaust hood assembly 11 coincides with the front wall 33 of grease extractor 5. More specifically, front wall 33 is in the form of a flat plate provided with a suitable opening to mount a door 35 in known manner therein. As will readily be appreciated by one skilled in the art, door 35 permits access inside the grease extractor and the ventilator for various reasons, such as, inspection, repair, access to fire spray nozzle and the like.

As shown, front wall 33 has a lower edge which is shaped into a first hook 37, the purpose of which will immediately be defined. Referring again to the drawings, more particularly to bucket 9, it will be seen that the latter is of a box-like open construction with a vertical front partition 39 and a rear partition 41 which is upwardly and inwardly inclined with respect to the hood. Referring to vertical front partition 39 of bucket 9, it will be seen that its upper edge is shaped into a second hook 43 capable of engagement with hook 37 to hold bucket 9 in the position illustrated in FIG. 1. Finally, in order to maintain bucket 9 in the position illustrated in full line in the drawing, the hood is provided with a vertical portion 45 which extends downwardly from secondary horizontal portion 47, and serves the additional purpose of blocking the view of the bucket and other equipment of the exhaust hood assembly. A support 49 is disposed against the rear face of vertical portion 45, all as shown in the drawing. It will be seen that to mount bucket 9 on the exhaust hood assembly it is merely sufficient to engage hooks 37 and 43 while bucket 9 is upwardly tilted, and thereafter allowing front partition 39 to rest against support 49, all as shown herein.

To provide the grease extractor, which in the present embodiment is truncated with decreasing rectangular cross-section, a rear wall 51 is disposed as shown, to downwardly extend at the lower inlet 17 of suction ventilator 7. As shown, rear wall 51 extends to a level slightly below the lower edge of front wall and is terminated by an inwardly slanted wing member 53. In addition, inside grease extractor 5 formed by front and rear walls 33, 51, top partition and side walls not shown, there is a vertical plate 55 fixed against rear wall 51 at a level slightly above the entrance into grease extractor 5. An additional vertical plate 56 is provided at the lower edge of front wall 33 and is directed opposite plate 55.

In order to feed excess grease centrifugally expelled by suction ventilator 7 and not retained thereon, into bucket 9, a piping 61 is provided. To achieve this, the piping is bent at 90° at 59 and is mounted as shown. More particularly, one end of piping 61 is connected at the base of ventilator enclosure 57. The horizontal part extends away from enclosure 57 towards rear wall 51 and from bent 59 it downwardly extends to a point just about bucket 9 where it will feed therein the excess grease centrifugally expelled by the ventilator blades.

For convenience a light bulb 65 is fixed in a socket 67 provided in the horizontal portion 32.

Finally, although this is not essential, in the illustrated embodiment there is provided a fire extinguishing facility which may be quite useful in case a product or composition is ignited while the cooking surface is in operation. This facility which is illustrated in the drawings includes a supply tank 65 of fire extinguishing material in the form of a tank which is disposed as shown inside the hood. Tank 65 is connected to a fluid duct 67 which extends all the way through grease extractor 5 to a junction 68 at an intermediate level just above plate 55. At junction 68 there is a horizontal extension of fluid duct 67 to a point below suction ventilator 1, which is followed by a further vertical extension to terminate into a sprayer 69, which is capable of spraying the fire extinguishing fluid over the cooking surface 27. Additionally, further sprayers **69*a*, 69*b* are provided, as shown, to spray the fluid respectively towards the bucket 9 and inside ventilator enclosure 57 to extinguish any fire therein. Finally, a fire detector 71 is disposed in a suitable location such as inside grease extractor 5, as shown. More particularly, fire detector 71 is mounted along wire element 73 which is connected to a thread-like element 75 which extends outside air duct 5, around pulleys 76 mounted in known manner, to an electrical contact, not shown, inside control box 79, and to a valve 81 mounted at the outlet of tank, which remains closed when the fire detector is not activated. Upon activation of the fire detector in case of fire, the mechanism will cause valve 81 to open enabling the extinguishing fluid to be sprayed through sprayers 69, 69*a* and 69*b***, and open electrical contacts to shut off gas valves or electrical appliances and close a circuit for fire alarm in the building.

The operation of the exhaust hood assembly is as follows, it being understood that proper electrical controls are provided, as is well known to those skilled in the art, to operate it. When preparing food which results in the production of grease and odor, the ventilator is set in motion. As a result of the suction produced by the suction ventilator, in a specific location to capture the natural warm air loaded with grease and odor which, according to its natural movement, starts to ascend along the path shown by arrows 77, will then swirl counterclockwise as a result of the shape of the hood and inclined rear 10 partition 41 of bucket 9. After entering into grease extractor 5 the fumes will first swirl around baffle plate 55 and then around baffle plate 56 in the direction of arrows 79 where a good portion of grease and solid particles will drip into bucket 9 to accumulate at the bottom thereof. Upon reaching suction ventilator 7 along the path of arrows 81, the fumes still loaded with grease and solid particles will be extracted by the centrifugal effect created by the fan blades and exit through piping 61 into bucket 9. The air and smell are sent into the outside atmosphere along the path of arrows 83.

Once in a while the bucket is removed, emptied of its content, and cleaned after which it is replaced in its alloted location.

Of course, modifications are possible within the scope and spirit of the present invention, and the invention is therefore not limited to the illustrated embodiment except as defined in the appended claims.

I claim:

1. A kitchen exhaust hood assembly for removing grease and odor produced above a cooking surface when cooking, which comprises a suction ventilator, a hood, a grease extractor to collect grease and direct odor produced when cooking toward said suction ventilator, and an air discharge duct to expel air and odors to the exterior, wherein said grease extractor is vertically disposed in the front part of the assembly opposite a front portion of the cooking surface in order to accentuate hot air movement coming from the cooking surface, and is in communication with said suction ventilator, said grease extractor being rectangular in cross-section and includes a front wall, a rear wall, side walls and a top partition, an opening being formed in the rear wall in the upper portion thereof to lead into an entrance of said suction ventilator, air loaded with grease and odor produced by said cooking surface naturally rising towards a rear portion of said hood, a first deflection means is provided at an entrance into said grease extractor to cause said air loaded with grease and odor produced above said cooking surface which has naturally risen upwardly therefrom towards said rear portion of said hood to curve downwardly in the direction of said entrance to penetrate therein, second deflection means are provided inside said grease extractor and arranged to cause said air loaded with grease and odor to swirl around said second deflection means, means enabling first excess grease material centrifugally expelled by said suction ventilator to be removed therefrom, and bucket means to receive second excess grease material released by said first and second deflection means and said first excess grease material expelled by said suction ventilator, said bucket means is shaped to define third deflection means allowing said air loaded with grease and odor to rise above said bucket means and thereafter to swirl around said bucket means downwardly towards an entrance into said grease extractor, said assembly also comprising an enclosure for said suction ventilator, and a tubing connected at a lower portion of said enclosure and terminating above said bucket means, said tubing adapted to feed said expelled grease material into said bucket means.

2. A kitchen exhaust hood assembly according to claim 1, which comprises a supply of fire extinguishing material, means for spraying said fire extinguishing material at least towards said cooking surface, a fire extinguishing material duct connecting said supply of fire extinguishing material to said spraying means and a fire detector operatively disposed to detect presence of fire in the vicinity of said ventilator hood and said suction ventilator, and to cause opening of a valve disposed along said fire extinguishing material duct to deliver said fire extinguishing material to said spraying means.

3. A kitchen exhaust hood assembly according to claim 2, wherein said spraying means comprises a supply of fire extinguishing material and a duct for said fire extinguishing material connected to said supply and extending through said grease extractor and over said cooking surface, sprayers mounted at a free end of said extinguishing material duct and along thereof to spray said cooking surface, said grease extractor and said suction ventilator.

4. A kitchen exhaust hood assembly according to claim 1, wherein said greast extractor is truncated with decreasing rectangular cross-section and includes a front wall, a rear wall, side walls and a top partition, an opening being formed in the rear wall in the upper portion thereof to lead into an entrance of said suction ventilator.

5. A kitchen exhaust hood assembly according to claim 1, comprising a bottom partition having inwardly upwardly inclined rear and front portions and a central substantially horizontal portion to cause a first swirling of said air loaded with grease and odor around said third deflection means.

6. A kitchen exhaust hood assembly according to claim 1, which comprises hooking means to mount said bucket means at a lower edge of said front wall of said grease extractor, said bucket means having an inclined rear face defining said third deflection means.

7. A kitchen exhaust hood assembly according to claim 1, which comprises a door provided in the front wall of said grease extractor to give access inside said grease extractor.

8. A kitchen exhaust hood assembly according to claim 1, wherein said second deflection means comprises a first vertical plate mounted inside said grease extractor against the front wall and at bottom thereof and terminating short of said rear wall and a second vertical plate mounted inside said grease extractor against the rear wall thereof and terminating short of said front wall.

* * * * *